United States Patent [19]

Reinhall

[11] 4,378,092

[45] Mar. 29, 1983

[54] METHOD AND APPARATUS FOR GRINDING PULP STOCK IN PULP DEFIBRATING APPARATUS OF THE DOUBLE ROTATING DISC TYPE

[75] Inventor: Rolf B. Reinhall, Bellevue, Wash.

[73] Assignee: Cell Develop, Inc., Bellevue, Wash.

[21] Appl. No.: 200,923

[22] Filed: Oct. 27, 1980

[51] Int. Cl.[3] ..... B02C 7/00

[52] U.S. Cl. ..... 241/16; 241/28; 241/163; 241/251; 241/259.1; 241/261.3

[58] Field of Search ..... 241/16, 21, 28, 29, 241/43, 60, 62, 161, 162, 163, 251, 259.1, 259.2, 261.1, 261.2, 261.3

[56] References Cited

U.S. PATENT DOCUMENTS 4,090,672 5/1978 Ahrel ..... 241/261.1

*Primary Examiner*—Mark Rosenbaum
*Assistant Examiner*—Timothy V. Eley
*Attorney, Agent, or Firm*—Eric Y. Munson

[57] ABSTRACT

Method and apparatus for grinding pulp stock in the grinding space of a defibrating apparatus, which space is defined between grinding surfaces carried by a pair of grinding discs, both of which rotate relative to one another within a closed housing, to thereby control the rate of flow of grist through the grinding space. The grinding space includes an inner grinding zone and two outer grinding zones which diverge at an angle to the radial plane of the inner zone. The inner grinding zone is defined between the two facially-opposed rotating discs in a plane substantially perpendicular to the axis of rotation, and the outer grinding zones are defined between portions of the two rotating discs which extend at an angle to the radial plane of the inner zone and correspondingly inclined facing surfaces of a stationary element such as a stator ring encasing the two rotating discs.

12 Claims, 2 Drawing Figures

16
58
18
46
60
44
42
64
26
34
30
61
48
49
63
47
62a
59
66
62
45
43
65
20
10
52
50
61a
61
PUMP
LIQUID SOURCE
HIGH PRESSURE LIQUID

METHOD AND APPARATUS FOR GRINDING PULP STOCK IN PULP DEFIBRATING APPARATUS OF THE DOUBLE ROTATING DISC TYPE

BACKGROUND OF THE INVENTION

In the refining process to which the grinding discs according to the invention are particularly applicable, the pulp stock or grist is ground in a grinding space defined between a pair of discs which rotate relative to one another within a closed housing. Each disc provides a grinding surface comprising conventional ridges and grooves which shear the fibers of the grist in grinding-like fashion. The pulp material, which may consist of wood chips, bagasse, fiber pulp or similar fibrous material, is fed by a screw feeder or the like through an opening in the central portion of one of the grinding discs into the "eye" of the grinding space and from which it is propelled by the centrifugal force generated by the rotational movement of the discs towards their periphery, where the grist is ejected with greatly accelerated force into the surrounding casing.

In order to generate the necessary centrifugal force to accelerate the stock from the inner central portion of the grinding space radially outwards and to obtain the desired degree of defibration and operating capacity in the grinding space, a high rotational speed must be imparted to the discs, such as on the order of 1500 r.p.m. to 3600 r.p.m. However, the resultant relatively high centrifugal force required to accelerate the stock from the inner disc portion, which determines the capacity of the apparatus, concommitantly subjects the grist as it progresses radially outwards to the outer disc portion to a progressively intensified centrifugal force. This intensified centrifugal force will accelerate the outward radial speed of the grist to such a degree that, unless special measures are taken to hold back the grist in the outer disc portion, the grist will be ejected prematurely from the grinding space, in only partly-treated condition, with consequent impairment of the defibration efficiency of the grinding apparatus. This problem becomes even more accentuated when steam or other vapor is generated during the grinding operation, as the result of high power input or dryness of the grist. The steam or other vapor will then flow with the grist outward through the grinding space between the discs and further accelerate the radial flow of the grist. As the centrifugal acceleration exerted on the grist is proportional to the disc diameter, as well as to the square of the r.p.m. of the disc, according to Newton's law of force and motion, the larger the diameter of the disc in the apparatus, the greater will be the problem of controlling the flow of the grist through the outer portion of the grinding space. Depending on application and capacity demand, grinding apparatuses used today normally have a disc diameter ranging between 20" and 64". Even if the larger diameter discs should be rotated at relatively slow speeds varying between 900 r.p.m. and 1800 r.p.m., they will still produce a centrifugal force of acceleration on the grist in the order of 700 g's to 2800 g's. Assume, for example, that a disc rotating at 900 r.p.m. generates a centrifugal force of 700 g's; if the the r.p.m. should be increased to 1800 r.p.m., the centrifugal force will be increased by a factor of 4, thus generating an increased centrifugal force of 2800 g's.

While discs of large diameter are desirable for capacity reasons, they require large amounts of energy, which is partly wasted because of their high peripheral velocity and consequent intensified centrifugal force, which renders the peripheral portion of the grinding space substantially ineffective for defibrating purposes.

Because of increasing demand for large capacity defibration equipment with adequate refining efficiency, it has proved to be a problem in the industry to properly control the radial passage of the stock between the outer part of the opposed grinding discs so as to obtain maximum performance. It should be understood that, as the stock progresses through the radial passage, it migrates alternately between the grinding surfaces on the opposing discs, and the more work on the stock in a single pass, i.e., the longer the dwell time in the grinding space, the more efficient and economical becomes the refining process. Unless the stock flow is properly retarded, the movement of the pulp becomes too rapid, as explained herein, and the defibrating action is minimized. Heretofore, attempts have been made to retard the passage of the grist through the grinding space by arranging the ridges and grooves in the grinding segments so that they can serve additionally as flow retarders. Such attempts are exemplified by U.S. Pat. No. 3,674,217, dated July 4, 1972, and U.S. Pat. No. 3,974,471, dated Aug. 17, 1976, and U.S. Pat. No. 3,040,997 granted to Donald A. Borden on June 26, 1962, U.S. Pat. No. 3,125,306 to E. Kollberg et al and U.S. Pat. No. 1,091,654 to Hamachek.

While these ridges and grooves serve to retard the flow, they still do not provide full utilization of the entire working area of the grinding space, since the grooves or channels between the ridges are spread out over a greater area at the periphery than at the inner portion of the grinding space.

Another attempt to solve the problem of controlling the flow is exemplified by U.S. Pat. No. 4,090,672 dated May, 23, 1978, to Bo A. Ahrel. The primary object of that invention is to solve the problem created by the high pressure steam in the peripheral zone of the grinding space. In order to prevent the partly defiberized stock from being blown out from the peripheral grinding zone by the high velocity steam, Ahrel utilizes the centrifugal force to separate the stream and to open up an escape passage for the steam while retaining the steam-liberated stock between the opposing grinding surfaces.

Other examples of prior art are U.S. Pat. Nos. 1,098,325, 1,226,032, 3,684,200 and 3,845,909.

My co-pending patent application Ser. No. 877,809, filed on Feb. 17, 1978 now U.S. Pat. No. 4,253,613, discloses a method and apparatus for controlling the effect of centrifugal force on pulp stock while being ground in the grinding space of a defibrating apparatus. The preferred embodiment discloses a grinding space defined between a first stationary grinding disc and a second rotatable grinding disc. The grinding space comprises an inner grinding zone in a plane substantially perpendicular to the axis of rotation of the grinding discs, and an outer grinding zone extending at an angle to the radial plane of the first grinding zone. The angle of the outer grinding zone relative to the inner grinding zone is calculated to reduce the effect of the centrifugal force in the outer peripheral portion of the grinding discs, so as to cause the pulp stock to progress through the grinding space at a controlled rate of flow with full utilization of the entire working area of the grinding space and without any substantial fluid separation regardless of the dimension of the grinding discs.

The preferred embodiment of application Ser. No. 877,809 now U.S. Pat. No. 4,253,613 also discloses further control of the effect of centrifugal force on pulp stock by varying the degree of the angle between the grinding surfaces of the opposing discs relative to the generatrix of the grinding space in the outer inclined grinding zone.

My other co-pending application Ser. No. 021,184 filed Mar. 16, 1979 now U.S. Pat. No. 4,283,016, provides an improved method and apparatus for controlling the effect of centrifugal force on pulp stock as it is passed through a grinding space having an inner grinding zone defined between the grinding surfaces of two facially opposed counter-rotating grinding discs and an outer zone extending angularly from the inner zone and being defined between the grinding surface of one of the grinding discs and a stationary grinding surface, so as to utilize the entire working area of the grinding space without special additional retarding means while maintaining the stock in the environment of a fluid medium throughout its passage in the grinding space and to prevent the escape of grist from the grinding space as the grist passes from the first to the second portion of the grinding space.

The object of the present invention is to provide an improvement of the method and apparatus disclosed and claimed in my aforesaid application Ser. No. 021,184.

SUMMARY OF THE INVENTION

The present invention contemplates one inner grinding zone defined between a pair of facially opposed discs, both of which rotate relative to one another and which inner zone extends from a central portion to a peripheral terminal portion, and two outer grinding zones diverging from said inner zone, each of said outer grinding zones being defined between a rotary grinding surface extending from the peripheral terminal portion of said inner grinding zone at an angle to the radial plane thereof and a correspondingly inclined facing stationary grinding surface carried by a stationary member, such as a stator ring encasing the discs of the inner grinding zone.

The angle of the two outer grinding zones relative to the first grinding zone is calculated according to the dimensions of the rotatable grinding discs and the dwell time required for optimum refining efficiency. In the inner grinding zone, full utilization of centrifugal force is maximized in order to increase the accelerating force on the stock to move it continuously away from the feed-in opening or "eye" of the first grinding zone. In the outer grinding zones, the centrifugal force is split into a radial vector force and an axial vector force, thus reducing the accelerating force in the direction of outward flow, while prolonging the dwell time in the grinding zones, with resultant utilization of each zone for optimum refining efficiency.

A further object of the present invention is to increase the grinding area of the outer grinding zone disclosed by the prior art, without any substantial change of the outlet diameter thereof. This object is achieved by providing each of the two rotating discs with a rotating grinding surface which extends from the terminal peripheral portion of the inner grinding zone at an angle to the radial plane thereof and arranging between the thus inclined grinding surfaces a stationary axially spreadable stator ring provided with corresponding stationary grinding surfaces. The increased grinding area of the outer grinding zones is thus defined between the inclined rotating surfaces and the correspondingly inclined grinding surfaces on the stator ring. Accordingly, the pulp stock, after having undergone a grinding operation in the inner grinding zone, is divided into two diverging portions, each of which will be independently refined in the two diverging outer refining zones.

DETAILED DESCRIPTION OF A PREFERRED EMBODIMENT OF THE INVENTION

Figure 1:
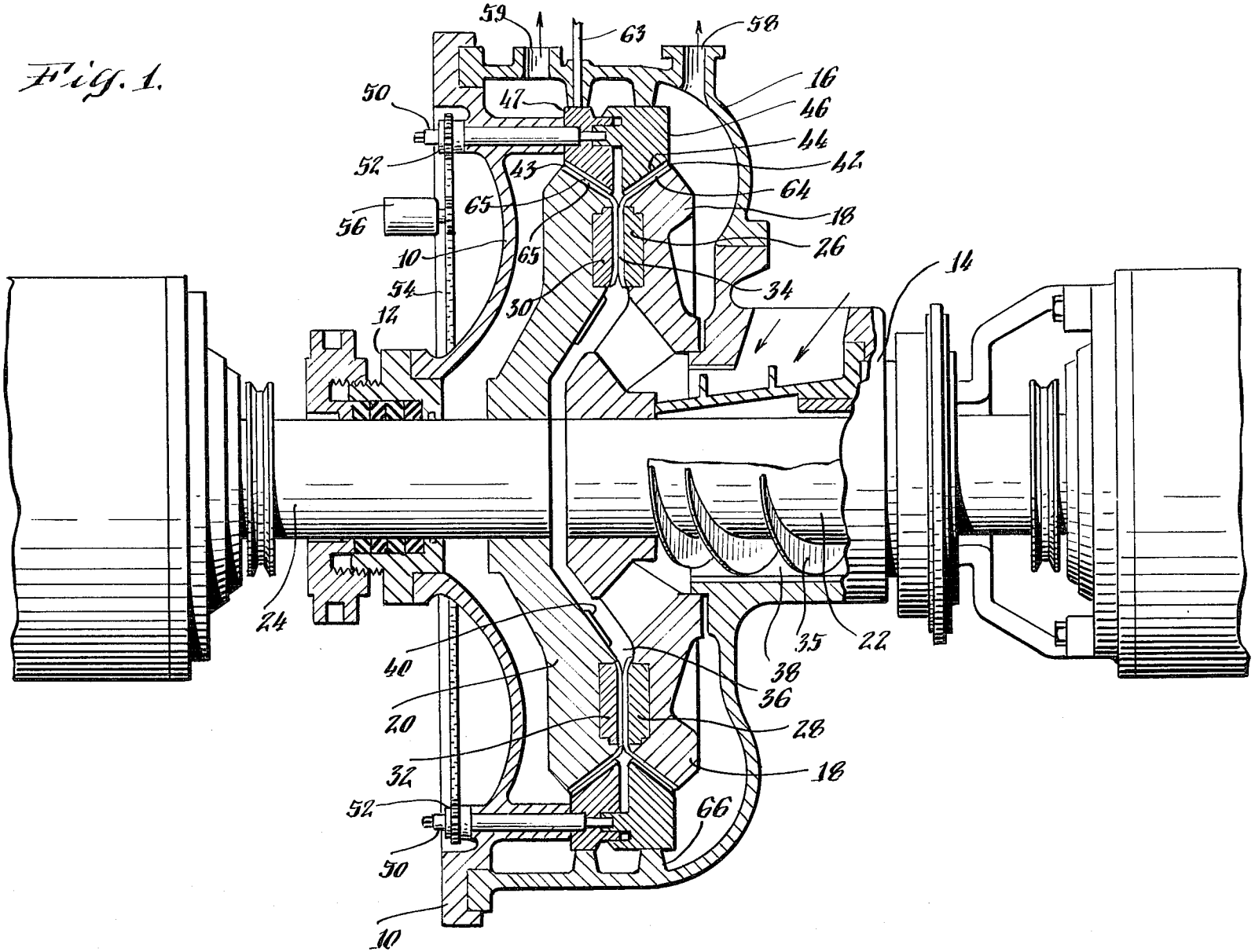
FIG. 1 is a vertical section of a portion of a defibrating apparatus embodying the invention disclosed herein.

Referring to the drawings, reference numeral 10 indicates a casing or housing which is sealed by packing boxes 12 and 14. The housing has a removable segment indicated by numeral 16. A first rotatable disc 18 and a second rotatable disc 20 are mounted within the housing on shafts 22 and 24, respectively. The shafts are journaled into a frame of the apparatus in a conventional manner, as shown, for example, in U.S. Pat. No. 3,212,271. The opposing faces of the discs are provided with grinding surfaces, such as conventional grinding segments 26, 28 and 30, 32, as shown, for example, in U.S. Pat. No. 3,974,491, defining a first grinding zone 34 therebetween. This first grinding zone extends outwardly towards the peripheral portion of the rotatable discs. The raw material, such as wood chips which have previously been conventionally steamed and preheated in a steaming vessel (as shown in U.S. Pat. No. 4,030,969), is fed by concentric screw 35 surrounding the shaft 22, through a central opening in the first disc 18 which forms a feed-out zone or "eye" 36 in the throat member 38 which is connected to the frame of the apparatus. From the "eye" 36, the steamed chips or the like are accelerated radially outwards by the centrifugal force created by the rotational movement of the first and second discs 18 and 20.

The grinding segments 26 and 28, 30 and 32 on the respective discs 18 and 20 are removably mounted in conventional manner, as shown, for example, in U.S. Pat. No. 3,827,644. These grinding surfaces may be defined on the surfaces of rings, as disclosed in aforementioned co-pending U.S. application Ser. No. 877,809. A deflector member 40 may also be provided to deflect the material in the "eye" 36 into the inner grinding zone 34. The discs 18 and 20 can be individually adjusted axially by conventional means (not shown) of the type as shown, for example, in the aforesaid U.S. Pat. No. 3,827,644.

The inner grinding zone 34 merges with two inclined diverging outer grinding zones 42 and 43, which extend at an angle relative to the inner grinding zone, thus forming a combined grinding space having a frustoconical profile in the example shown.

As more fully explained in co-pending U.S. application Ser. No. 877,809, filed Feb. 17, 1978 now U.S. Pat. No. 4,253,613, the combined grinding space comprising the merging inner and outer grinding zones reduces the effect of the centrifugal force on the pulp stock introduced into the inner grinding zone, and accordingly retards the outward acceleration of these materials. Consequently, the dwell time of the raw material in the grinding zones is prolonged, with resultant utilization of each grinding zone for optimum refining efficiency. As explained in my aforementioned application, the inclined angle of the outer grinding zones splits the centrifugal force acting upon the raw material into a radial vector force and an axial vector force, thus reducing the accelerating force in the direction of outward flow, while prolonging the dwell time of the material in the grinding space.

Referring back to the drawings, the outer grinding zones 42 and 43 are defined between the grinding surfaces 64 and 65 respectively, of the rotatable discs 18 and 20, and stationary grinding surfaces 44 and 45 defined on the stator rings 46 and 47, respectively. The stator ring 47 is fixedly mounted to the housing 10 by the hollow bolt 66, while the stator ring 46 is mounted for axial adjustment relative to stator ring 47. The distance between the stationary grinding surface 44 and the grinding surface of the rotatable grinding disc 18 is adjustable by means of a hydraulic medium of suitable pressure introduced into chamber 48 through channel 49. Pressure of the hydraulic medium can be used to displace the stator ring 46 in a direction towards the rotatable grinding disc 18, and, accordingly, decrease the width of the outer grinding zone 42. Such movement is restricted by a plurality of screw tappets 50 arranged around the stator ring 47 and a plurality of stop nuts 52. The stop nuts are simultaneously driven by a chain drive 54 and a motor 56, as shown in FIG. 1 of the drawing. Thus, the width of the outer grinding zone 42 can be adjusted independently of the width of the inner grinding zone 34, and vice versa.

The width of the grinding zone 43 can likewise be adjusted independently of the width of outer grinding zone 42 by axially adjusting the disc 20 and by corresponding adjustment of the disc 18 and the adjustable stator ring 46, in order to maintain the width of the grinding zones 34 and 42.

Removable segment 16 of the housing 10, which can be pressure-sealed against the housing when the apparatus is operating, can be removed to provide access to the grinding segments of the grinding surfaces for repair and replacement thereof. The housing also has two discharge openings 58 and 59 which can be provided with an adjustable blow valve of conventional construction (not shown).

Figure 2:
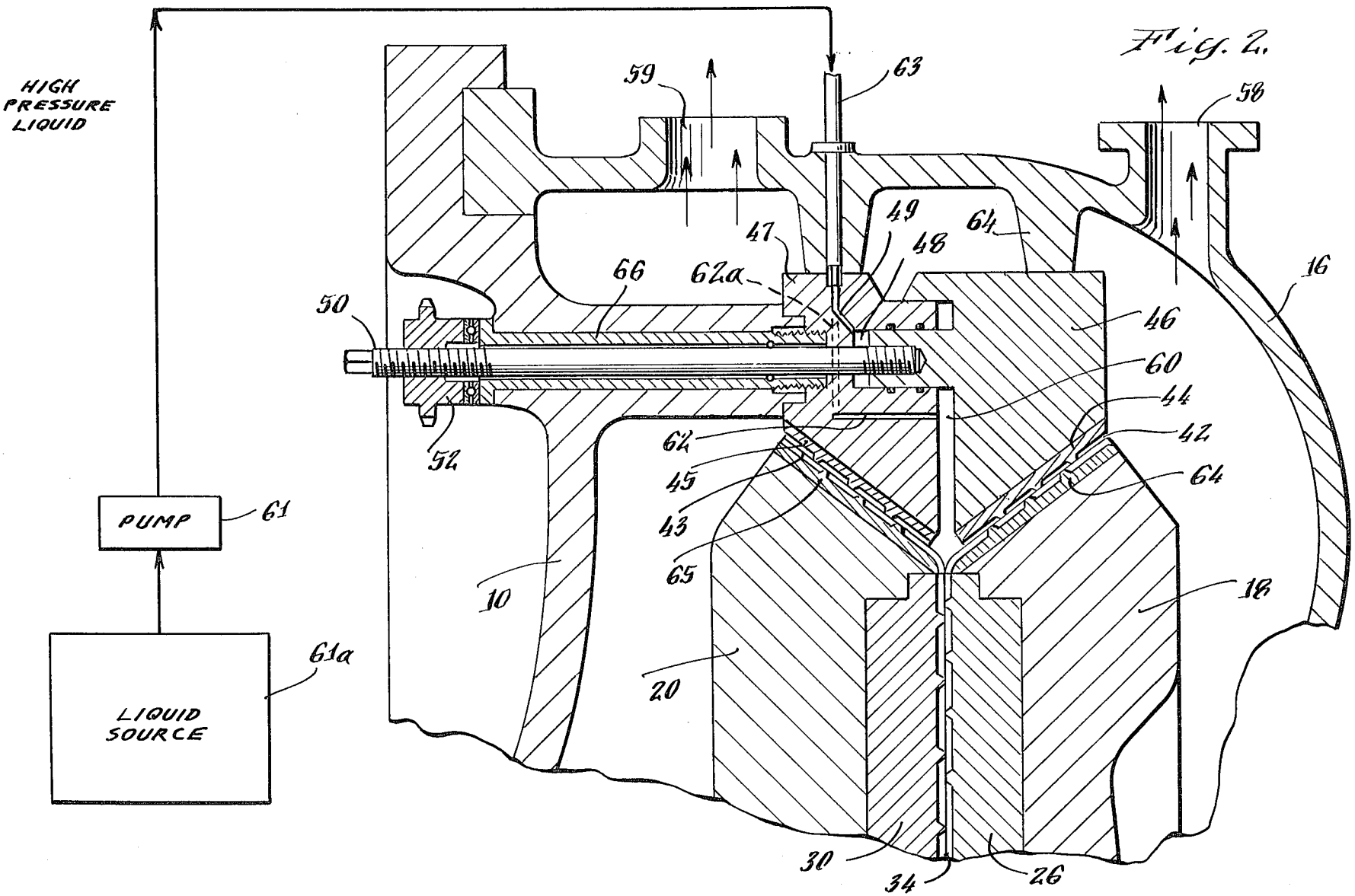
FIG. 2 shows a blown-up portion of the defibrating apparatus illustrated by FIG. 1.

As seen more clearly from FIG. 2, a gap 60 intersects and opens into the grinding space of the apparatus at the approximate region where the inner grinding zone 34 merges with the outer diverging grinding zones 42 and 43. Consequently, there is a possibility that a portion of the raw material or grist passing through the inner grinding zone 34 will enter the gap 60, causing plugging of that gap. This possibility is enhanced because the gap opens into the region of the grinding area at which the diverging angled outer grinding zones merge with the inner grinding zone. Because the direction of flow of the grist is changed in this region of the grinding area, a portion of the grist might be deflected into the gap 60. Plugging of the gap by the grist is quite undesirable because such plugging will interfere with the axial adjustment of stator ring 46.

To prevent the filling up and plugging of the gap 60 by grist or other materials passing through the grinding zones, a plurality of channels 62 are associated with the stator ring 47 and connected with the gap 60. These channels conduct a fluid, as, for example, chemical solutions, water, steam, air, etc., or combinations thereof, into the gap 60 through a plurality of pipes 63 connected to the stator ring 47. As shown by FIG. 1, fluid medium from a source **61*a* is pumped into the gap 60 via pipe 63 and channels 62 and 62*a* by pump 61. The amount of fluid medium introduced into gap 60** can be adjusted to achieve effective removal of grist entering the gap.

The fluid medium introduced into the gap 60 will enter the grinding space at the region where the inner grinding zone 34 merges with the two outer grinding zones 42 and 43 and at this point will mix with the passing grist to thereby supply desirable cooling and lubrication of the grist. The fluid medium can advantageously also be utilized for adding chemicals desired for the pulping process, such as bleaching compounds, binding agents, etc.

The improvement provided by the present invention over the method and apparatus described and claimed in my U.S. application Ser. No. 021,184 resides in the provision of a second outer grinding zone 43 defined between the fixed stator ring 47 and the grinding surface 45 of the second rotatable disc 20. One end of each of the two grinding zones 42 and 43 opens into the area proximate to the intersection of the inner grinding zone 34, where it merges with the outer angled grinding zone 42. The opposite ends of the two angled grinding zones open into the same general discharge area, however separated from one another.

The outer grinding zone 43 is angled relative to the inner grinding zone 34 but diverges in opposite direction to that of the outer grinding zone 42. As shown more clearly in FIG. 2, the degree of the angle of grinding zone 43 relative to the inner grinding zone 34 can be equal to the angulation of the outer grinding zone 42 relative to said inner grinding zone. Also, as shown in the drawings, the inner grinding zone 34 and the outer grinding zones 42 and 43 appear to form a "Y" shaped configuration. In the alternative, the degree of angulation between the two outer grinding zones relative to the inner grinding zones can be varied. The fact that the grinding zone 43 is angled relative to the inner grinding zone 34 reduces the effect of the centrifugal force accelerating the grist through the grinding zone 43, for the same reasons as explained in my co-pending application, U.S. application Ser. No. 021,184 relative to the outer grinding zone 42.

In operation, raw material, usually called "furnish" is fed into the eye 36 and is radially propelled through the inner grinding zone 34 by the centrifugal force generated by the rotating discs. When the resultant grist reaches the intersection between the grinding zones 42 and 43, the flow of grist will be divided between the two diverging grinding zones, generally in proportion to the spacing between grinding surfaces 44, 64 and 45, 65, respectively, or blow valve restrictions in the outlets 59 and 58. In the drawings, the width of the two outer grinding zones is shown as being approximately equal in width. Accordingly, when the grinding spaces between grinding surfaces 44, 64 and 45, 65, respectively, are equal, the blow valves have the same adjustment; approximately one half of the grist from the first grinding zone 34 will be propelled through grinding zone 43, while the other half of the grist will be propelled through the grinding zone 42. The relative widths of the grinding zones 42 and 43 can be varied, as explained herein, to vary the relative quantities of grist passing through each outlet. That is, the larger the width of one of the grinding zones, the greater will be the quantity of grist passing through that zone.

One advantage of providing two outer grinding zones 42 and 43 is to increase the total grinding area and thereby the capacity or discharge of grist from the refiner.

In the embodiment shown in the drawings, grist from both grinding zones 42 and 43 is discharged into the same general area in the refiner housing, but separated from one another by partition 64 so that the refined grist from grinding zone 43 is maintained apart from the grist emanating from grinding zone 42, thereby permitting separate samplings of the grist necessary to determine the individual settings of grinding zones 42 and 43.

The description of the improvement provided herein is intended to be illustrative only and not restrictive of the scope of the claims, that scope being defined by the following claims and all equivalents thereto.

I claim:

1. In the method of refining pulp stock in which the pulp material to be ground is introduced into a grinding space including an inner grinding zone defined between a pair of facially-opposed axially adjustable grinding discs, both of which rotate relative to each other within a closed housing, and in which inner grinding zone the pulp material is accelerated from a central portion outwardly towards a peripheral portion by the centrifugal force generated by the rotational movement of the rotatable discs, the improvement comprising:

providing two outer grinding zones diverging in opposite axial directions from the peripheral portion of said inner grinding zone for receiving the pulp material accelerated through said inner zone and dividing its direction of flow into two separate paths, said grinding zone being defined between said rotatable discs and a stationary grinding surface on at least a portion of the surface of a stationary element mounted within said housing.

2. The method according to claim 1, including adjusting the stationary element to vary the width of said outer grinding zones.

3. The method according to claim 2, including individually adjusting the width of each of said outer grinding zones by dividing said stationary element into two separate members which are axially adjustable relative to one another.

4. The method according to claim 3, in which said relatively adjustable members are spaced apart to provide a gap therebetween, one end of said gap being closed and the other end thereof communicating with the grinding zones in the approximate region where the inner grinding zones merge with the two outer grinding zones and into which gap pressurized fluid is introduced to prevent plugging thereof by grist deflected from the grinding zones.

5. The method of claim 1, including communicating the pulp material from said outer grinding zones with a common discharge area.

6. The method according to claim 1, including communicating the pulp material from said outer grinding zones communicates with separate discharge areas.

7. In a double disc pulp defibrating apparatus in which the pulp material to be ground is introduced into a grinding space including an inner grinding zone defined between a pair of facially opposed and axially adjustable grinding discs, both of which rotate relative to each other within a closed housing and in which inner grinding zone the pulp material is accelerated from a central portion outwardly towards a peripherally outer portion by the centrifugal force generated by the rotational movement of the rotatable discs, the improvement comprising:

(a) an axially inclined portion on each of said rotating discs extending from the peripherally outer end of said inner grinding zones and forming two diverging rotating grinding surfaces;

(b) a stationary element mounted on said housing, having grinding surfaces defined on a portion thereof facing said diverging rotating grinding surfaces, defining therebetween two outer diverging grinding zones for receiving the pulp material accelerated through said inner grinding zones and dividing its direction of flow into two separate paths; and (c) means for discharging the grist from the housing.

8. A double disc defibrating apparatus according to claim 7, in which said stationary element is axially extendable to vary the width of said outer diverging grinding zones.

9. A double disc defibrating apparatus according to claim 8, in which said stationary element comprises two stator rings which are axially adjustable relative to one another.

10. A double disc defibrating apparatus according to claim 9, in which one of said stator rings is fixedly mounted to the housing and the other one of said stator rings is adjustable axially relative thereto by a hydraulic medium introduced into a chamber defined between said stator rings.

11. A double disc defibrating apparatus according to claims 7, 8, 9 or 10, further comprising means for discharging the grist separately from said diverging grinding zones.

12. A double disc defibrating apparatus according to claims 9 or 10, in which said stator rings slidably engage one another to define therebetween a gap which is closed at one end and at the other end opens into a region approximately where the inner grinding zone and the two outer grinding zones merge and into which gap a hydraulic medium is introduced to prevent plugging thereof by grist deflected from the grinding zones.

* * * * *